US006220458B1

(12) United States Patent
Falor

(10) Patent No.: US 6,220,458 B1
(45) Date of Patent: Apr. 24, 2001

(54) BOTTLE RACK SYSTEM

(76) Inventor: Brian K. Falor, 2800 S. Eastern Ave., Las Vegas, NV (US) 89019

( * ) Notice: Subject to any disclaimer, the term of this patent is extended or adjusted under 35 U.S.C. 154(b) by 0 days.

(21) Appl. No.: 09/243,407

(22) Filed: Feb. 1, 1999

(51) Int. Cl.[7] ..... A47B 73/00
(52) U.S. Cl. ..... 211/74; 248/311.3
(58) Field of Search ..... 211/74; 248/309.1, 248/312, 312.1, 311.3, 146, 94; 141/375

(56) References Cited

U.S. PATENT DOCUMENTS

| | | | | |
|---|---|---|---|---|
| 1,293,019 | * | 2/1919 | Brown | 248/309.1 |
| 1,742,150 | * | 12/1929 | Rollins | 141/106 X |
| 2,047,876 | * | 7/1936 | Knepp | 248/94 |
| 2,419,040 | * | 4/1947 | Stepanian | 211/74 |
| 2,509,098 | * | 5/1950 | Howard | 248/94 |
| 2,883,057 | * | 4/1959 | Richards | 210/476 |
| 4,217,941 | * | 8/1980 | Catalano | 141/372 |
| 4,271,878 | * | 6/1981 | Bologa | 248/311.3 X |
| 4,454,897 | | 6/1984 | Valiant | 141/364 |
| 5,080,150 | | 1/1992 | Deadwyler, Jr. | 141/364 |
| 5,146,957 | | 9/1992 | Belokin, Jr. et al. | 141/1 |
| 5,215,133 | | 6/1993 | Lambert | 141/364 |
| 5,297,600 | | 3/1994 | Downes et al. | 141/364 |
| 5,560,406 | * | 10/1996 | Fineroff et al. | 248/312 X |
| 5,794,904 | * | 8/1998 | Hackley | 248/311.3 |
| 5,865,094 | * | 2/1999 | Kealy | 141/106 X |

* cited by examiner

*Primary Examiner*—Daniel P. Stodola
*Assistant Examiner*—Khoa Tran
(74) *Attorney, Agent, or Firm*—Joseph N. Breaux

(57) ABSTRACT

A bottle rack system for storing direct dispense bottles, such as used to store and dispense ketchup, salad dressing, steak sauce, etc., in an inverted position with the bottle cap positioned below the bottle bottom so that the contents of the bottle accumulate adjacent to the dispensing opening of the direct dispense bottle so as to be readily available for dispensing. The bottle rack system includes a bottle support member, a slide-in drip tray, two small diameter neck inserts, and two medium diameter neck inserts.

2 Claims, 3 Drawing Sheets

BOTTLE RACK SYSTEM

TECHNICAL FIELD

The present invention relates to bottle storage shelves and more particularly to a bottle rack system for storing direct dispense bottles, such as used to store and dispense ketchup, salad dressing, steak sauce, etc., in an inverted position with the bottle cap positioned below the bottle bottom so that the contents of the bottle accumulate adjacent to the dispensing opening of the direct dispense bottle so as to be readily available for dispensing; the bottle rack system including a bottle support member, a slide-in drip tray, two small diameter neck inserts, and two medium diameter neck inserts; the bottle support member being U-shaped and including a pair of parallel oriented end portions connected by a perpendicularly oriented middle portion; an inner bottom edge of each of the parallel oriented end portions having a drip tray insertion channel formed along the length thereof sized to receive and hold an edge of the slide-in drip tray; the middle portion having two circular bottle neck openings formed therethrough of a first diameter and four bottle anti-tip structures extending downwardly from the middle portion, between the two end portions, and spaced around the perimeter of each of the circular bottle neck openings; the slide-in drip tray including a rectangular shaped, plastic planar tray portion having two drip receiving depressions formed therein for receiving and holding drips from bottles positioned through the bottle neck openings of the bottle support member; each of the small and medium diameter neck inserts being formed from a resilient plastic and including a center portion having a diameter equal to the first predetermined diameter, a tapered insertion tip formed at one end of the center portion, a support member contact flange formed at a second end of the center portion, and a tapered bottle neck insertion passageway formed through the support member contact flange, the center portion, and the tapered insertion tip; the tapered bottle neck insertion passageway tapering in diameter from a larger diameter cap insertion opening formed through the support member contact flange to a smaller diameter cap exit opening formed through the tapered insertion tip.

BACKGROUND ART

It is often time consuming and frustrating to dispense the contents of a direct dispense bottle, such as shampoo, ketchup, steak sauce, salad dressing, bar-b-que sauce, etc. It would be a benefit, therefore, to have a bottle rack system for storing direct dispense bottles in an inverted position with the bottle cap positioned below the bottle bottom so that the contents of the bottle accumulate adjacent to the dispensing opening of the direct dispense bottle so as to be readily available for dispensing. Because direct dispense bottles come in various sized and have necks of various diameters, it would be a further benefit if the bottle rack system included a number of inserts, each adapted for use with a different sized bottle, that could used to adapt the shelf system to a particular bottle if desired.

GENERAL SUMMARY DISCUSSION OF INVENTION

It is thus an object of the invention to provide a bottle rack system that includes a bottle support member for holding a bottle in an inverted position.

It is a still further object of the invention to provide a bottle rack system that includes a number of inserts each adapted for use with a different sized bottles.

It is a still further object of the invention to provide a bottle rack system that includes a bottle support member, a slide-in drip tray, two small diameter neck inserts, and two medium diameter neck inserts; the bottle support member being U-shaped and including a pair of parallel oriented end portions connected by a perpendicularly oriented middle portion; an inner bottom edge of each of the parallel oriented end portions having a drip tray insertion channel formed along the length thereof sized to receive and hold an edge of the slide-in drip tray; the middle portion having two circular bottle neck openings formed therethrough of a first diameter and four bottle anti-tip structures extending downwardly from the middle portion, between the two end portions, and spaced around the perimeter of each of the circular bottle neck openings; the slide-in drip tray including a rectangular shaped, plastic planar tray portion having two drip receiving depressions formed therein for receiving and holding drips from bottles positioned through the bottle neck openings of the bottle support member; each of the small and medium diameter neck inserts being formed from a resilient plastic and including a center portion having a diameter equal to the first predetermined diameter, a tapered insertion tip formed at one end of the center portion, a support member contact flange formed at a second end of the center portion, and a tapered bottle neck insertion passageway formed through the support member contact flange, the center portion, and the tapered insertion tip; the tapered bottle neck insertion passageway tapering in diameter from a larger diameter cap insertion opening formed through the support member contact flange to a smaller diameter cap exit opening formed through the tapered insertion tip.

It is a still further object of the invention to provide a bottle rack system that accomplishes all or some of the above objects in combination.

Accordingly, a bottle rack system is provided. The bottle rack system includes a bottle support member, a slide-in drip tray, two small diameter neck inserts, and two medium diameter neck inserts; the bottle support member being U-shaped and including a pair of parallel oriented end portions connected by a perpendicularly oriented middle portion; an inner bottom edge of each of the parallel oriented end portions having a drip tray insertion channel formed along the length thereof sized to receive and hold an edge of the slide-in drip tray; the middle portion having two circular bottle neck openings formed therethrough of a first diameter and four bottle anti-tip structures extending downwardly from the middle portion, between the two end portions, and spaced around the perimeter of each of the circular bottle neck openings; the slide-in drip tray including a rectangular shaped, plastic planar tray portion having two drip receiving depressions formed therein for receiving and holding drips from bottles positioned through the bottle neck openings of the bottle support member; each of the small and medium diameter neck inserts being formed from a resilient plastic and including a center portion having a diameter equal to the first predetermined diameter, a tapered insertion tip formed at one end of the center portion, a support member contact flange formed at a second end of the center portion, and a tapered bottle neck insertion passageway formed through the support member contact flange, the center portion, and the tapered insertion tip; the tapered bottle neck insertion passageway tapering in diameter from a larger diameter cap insertion opening formed through the support member contact flange to a smaller diameter cap exit opening formed through the tapered insertion tip.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
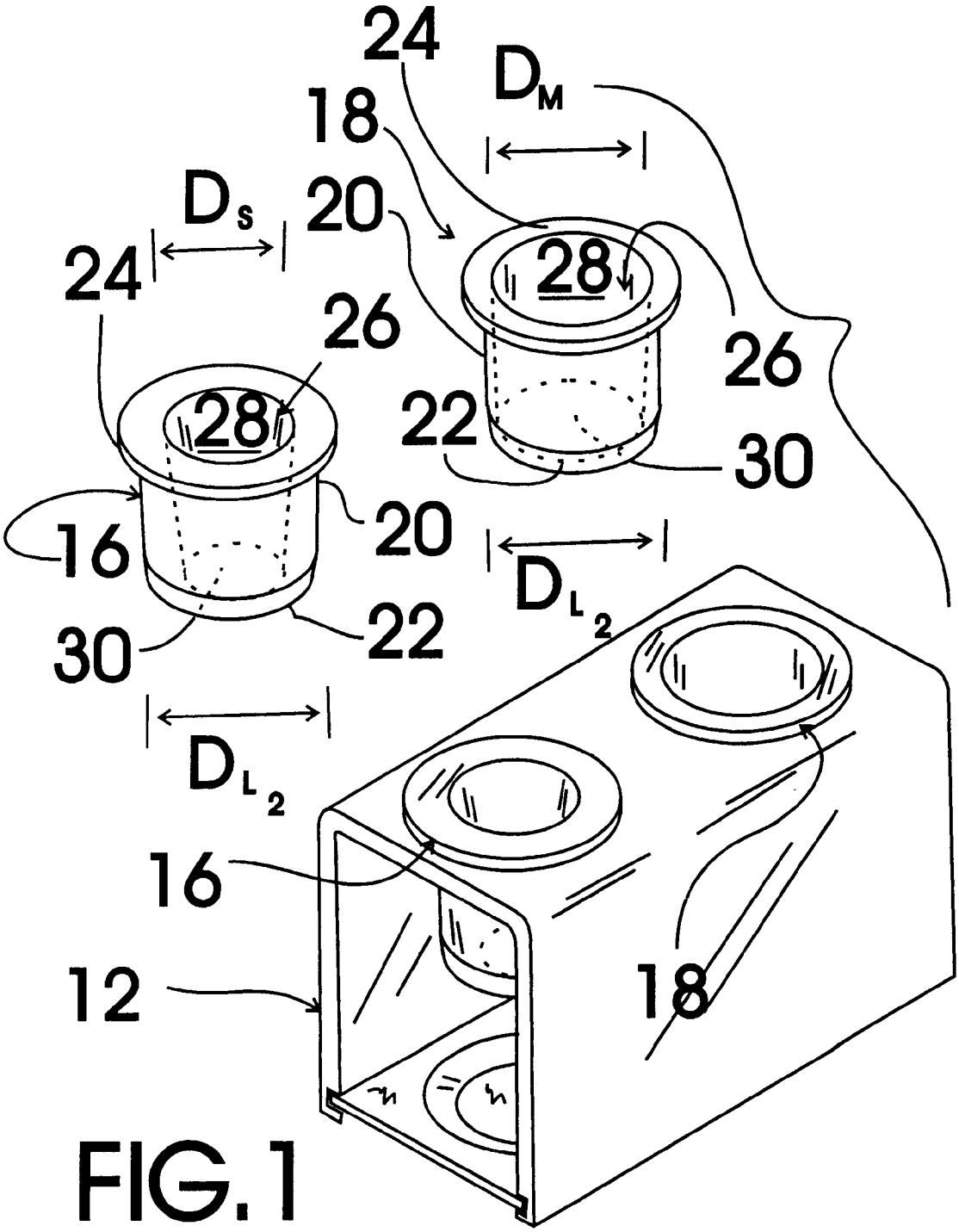
FIG. 1 is a perspective view of an exemplary embodiment of the bottle rack system of the present invention showing a bottle support member, a slide-in drip tray, two small diameter neck inserts, and two medium diameter neck inserts.

FIG. 1 shows an exemplary embodiment of the bottle rack system of the present invention generally designated 10. Bottle rack system 10 includes a U-shaped bent plastic bottle support member, generally designated 12; a slide-in drip tray, generally designated 14; two identical small diameter neck inserts, each generally designated 16; and two identical medium diameter neck inserts, generally designated 18. Each of the small and medium diameter neck inserts 16,18 is formed from a resilient plastic and includes a center portion 20, a tapered insertion tip 22, a support member contact flange 24 and a tapered bottle neck insertion passageway 26 that tapers in diameter from a larger diameter cap insertion opening 28 to a smaller diameter cap exit opening 30 (shown in dashed lines).

Figure 2:
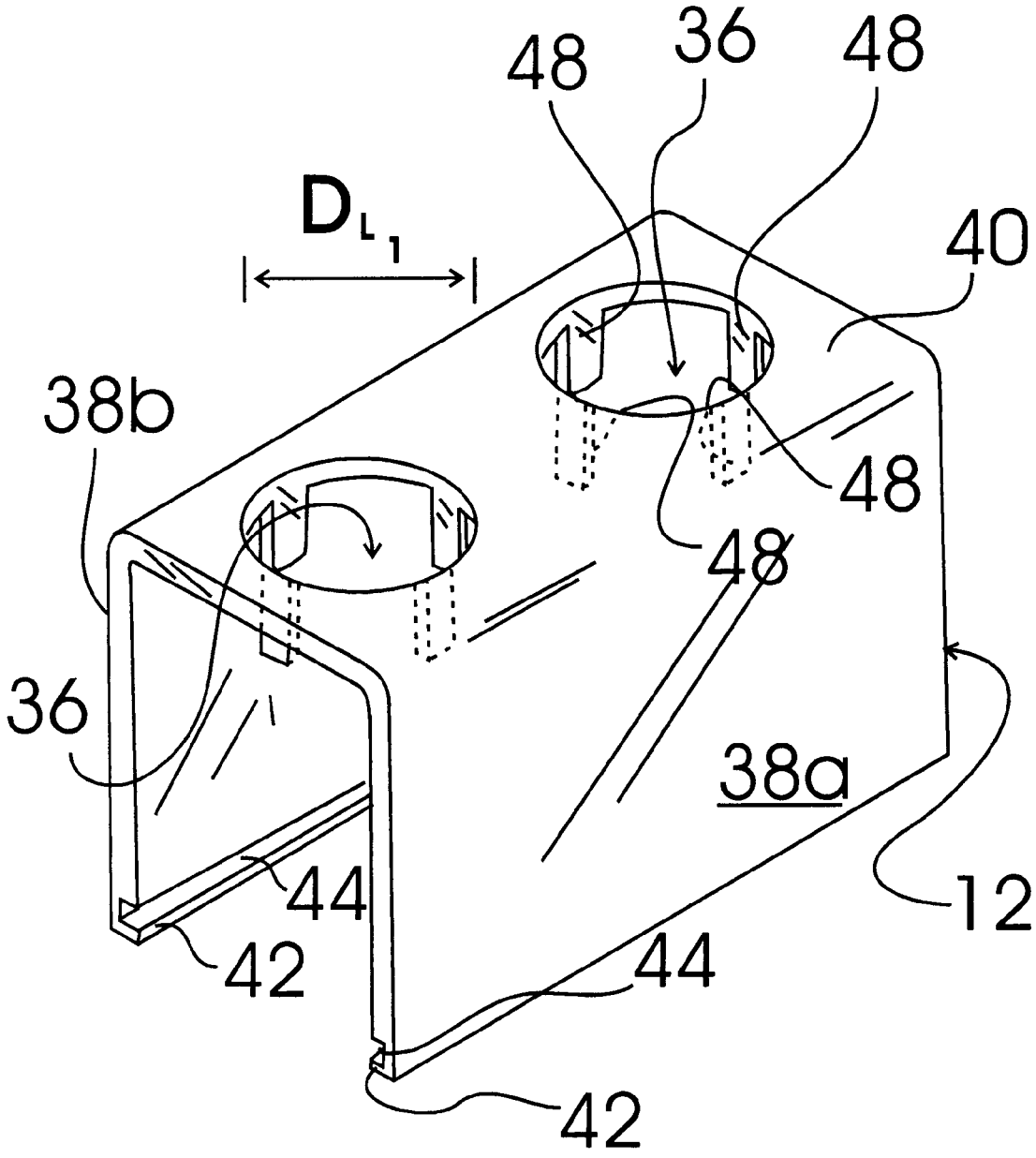
FIG. 2 is a perspective view of the exemplary bottle support member of FIG. 1 in isolation showing the generally U-shaped bent plastic bottle support member including a pair of parallel oriented end portions connected by a perpendicularly oriented middle portion.

FIG. 2 shows U-shaped bent plastic bottle support member 12 in isolation with the small and medium diameter neck inserts 16,18 (FIG. 1) removed from the two circular neck openings 36. U-shaped bent plastic bottle support member 12 includes a pair of parallel oriented end portions 38*a*,38*b* connected by an integrally formed, perpendicularly oriented middle portion 40. The inner bottom edge 42 of each of the parallel oriented end portions 38*a*,38*b* has a drip tray insertion channel 44 formed along the length thereof that is sized to receive and hold, referring to FIG. 3, a respective opposed side edge 46 of slide-in drip tray 14.

Referring back to FIG. 2, circular bottle neck openings 36 are formed through middle portion 40 and each have four, bottle anti-tip structures 48 that extend downwardly from middle portion 40 between end portions 38*a*,38*b* and that are spaced at ninety degree center intervals around the perimeter thereof. Bottle anti-tip structures 48 reduce tipping of the bottle. Each bottle neck opening 36 has a diameter $D_{L1}$ of two and one-half inches, referring back to FIG. 1, that is equal to the diameter $D_{L2}$ Of center portion 20 of the each of the small and medium diameter neck inserts 16,18. This allows the small and medium diameter neck inserts 16,18 to be deformably inserted into each bottle neck opening in a manner such that a holding force is generated to between the bottle anti-tip structures 48 (FIG. 2) and center portion 20. Medium diameter neck insert 18 has a larger diameter cap insertion opening 28 having a diameter $D_m$ that is smaller than diameter $D_{L1}$ of bottle neck opening 36 (FIG. 2). Small diameter neck insert 16 has a larger diameter cap insertion opening 28 having a diameter $D_s$ that is smaller than diameter $D_{L1}$ of bottle neck opening 36 (FIG. 2) and diameter Dm of medium diameter neck insert 18.

Figure 3A:
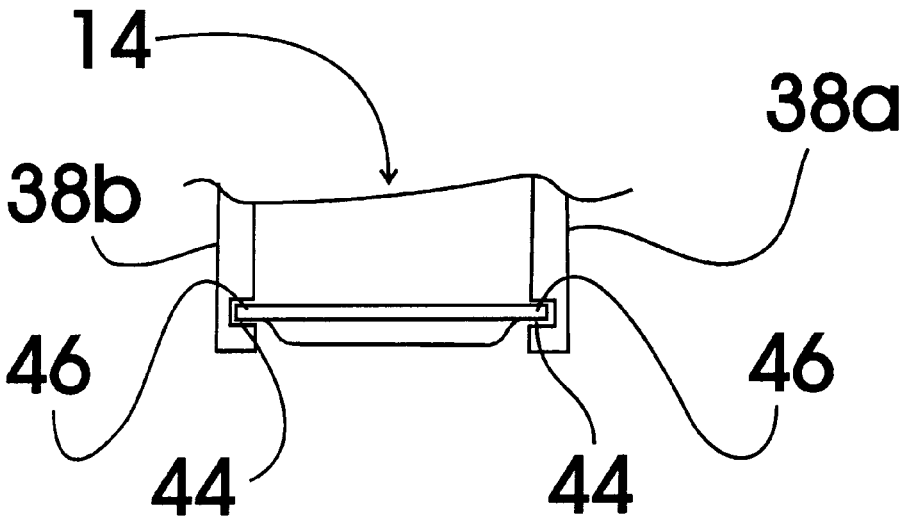
FIG. 3A is a side plan view showing the two side edges of the slide-in drip tray inserted into and held within the drip tray insertion channels of the parallel oriented end portions and the bottom of one of the two drip receiving depressions extending downward past the planar tray portion of the slide-in drip tray.
Figure 3:
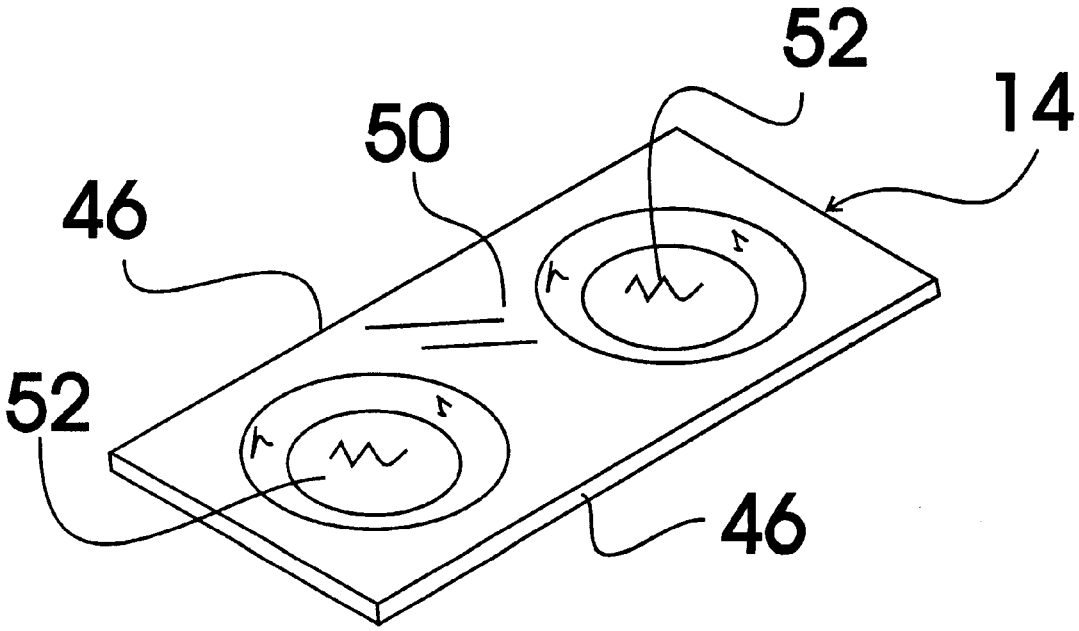
FIG. 3 is a perspective view of the exemplary slide-in drip ray of FIG. 1 in isolation showing the rectangular shaped, plastic planar tray portion having two drip receiving depressions formed therein for receiving and holding drips from bottles positioned through one of the bottle neck openings of the bottle support member.

Referring now to FIG. 3, slide-in drip tray 14 is constructed from plastic and includes a planar tray portion 50 having a rectangular shaped perimeter including opposed side edges 46. Two drip receiving depressions 52 are molded into planar tray portion 50 and are positioned such that one drip receiving depression 52 is positioned each of the bottle neck opening 36 (FIG. 2) when, referring now to FIG. 3A, side edges 46 of slide-in tray 14 are inserted into drip tray insertion channels 44 of parallel oriented end portions 38*a*,38*b*. It can be seen that slide-in tray 14 is easily removable for cleaning.

It can be seen from the preceding description that a bottle rack system has been provided that includes a bottle support member for holding a bottle in an inverted position; that includes a number of inserts each adapted for use with a different sized bottles; and that includes a bottle support member, a slide-in drip tray, two small diameter neck inserts, and two medium diameter neck inserts; the bottle support member being U-shaped and including a pair of parallel oriented end portions connected by a perpendicularly oriented middle portion; an inner bottom edge of each of the parallel oriented end portions having a drip tray insertion channel formed along the length thereof sized to receive and hold an edge of the slide-in drip tray; the middle portion having two circular bottle neck openings formed therethrough of a first diameter and four bottle anti-tip structures extending downwardly from the middle portion, between the two end portions, and spaced around the perimeter of each of the circular bottle neck openings; the slide-in drip tray including a rectangular shaped, plastic planar tray portion having two drip receiving depressions formed therein for receiving and holding drips from bottles positioned through the bottle neck openings of the bottle support member; each of the small and medium diameter neck inserts being formed from a resilient plastic and including a center portion having a diameter equal to the first predetermined diameter, a tapered insertion tip formed at one end of the center portion, a support member contact flange formed at a second end of the center portion, and a tapered bottle neck insertion passageway formed through the support member contact flange, the center portion, and the tapered insertion tip; the tapered bottle neck insertion passageway tapering in diameter from a larger diameter cap insertion opening formed through the support member contact flange to a smaller diameter cap exit opening formed through the tapered insertion tip.

It is noted that the embodiment of the bottle rack system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A bottle rack system comprising:

a bottle support member;

a slide-in drip tray;

a first neck insert; and a second neck insert;

said bottle support member being U-shaped and including a pair of parallel oriented end portions connected by a perpendicularly oriented middle portion;

an inner bottom edge of each of said parallel oriented end portions having a drip tray insertion channel formed along the length thereof sized to receive and hold an edge of said slide-in drip tray;

said middle portion having a circular bottle neck opening formed therethrough of a first diameter and four bottle anti-tip structures extending downwardly therefrom, between said two end portions, and spaced around the perimeter of said circular bottle neck opening;

said slide-in drip tray including a rectangular shaped, planar tray portion having two drip receiving depressions formed therein for receiving and holding drips from bottles positioned through said bottle neck opening of said bottle support member;

each of said first and second neck inserts including a center portion having a diameter equal to said first diameter, a tapered insertion tip formed at one end of said center portion, a support member contact flange formed at a second end of said center portion, and a tapered bottle neck insertion passageway formed through said support member contact flange, said center portion, and said tapered insertion tip;

said tapered bottle neck insertion passageway tapering in diameter from a larger diameter cap insertion opening formed through said support member contact flange to a smaller diameter cap exit opening formed through said tapered insertion tip;

said cap insertion opening and said cap exit opening, respectively, of said first neck insert being each smaller in diameter than said cap insertion opening and said cap exit opening, respectively, of said second neck insert;

said center portion of each of said first and second neck insert being separately insertable through said circular bottle neck opening such that said support member contact flange is supported on said middle portion.

2. The bottle rack system of claim 1 wherein:

each of said first and second neck inserts being formed from a resilient material.

* * * * *